United States Patent [19]

Egea et al.

[11] Patent Number: 4,874,241

[45] Date of Patent: Oct. 17, 1989

[54] APPARATUS FOR THE INSPECTION OF TUBULAR TEXTILE PRODUCTS

[75] Inventors: Noël Egea; Corinne Olive, both of Le Vigan, France

[73] Assignee: Societe Compagnie Generale Textile Cogetex, Le Vigan, France

[21] Appl. No.: 223,431

[22] Filed: Jul. 22, 1988

[30] Foreign Application Priority Data

Jul. 23, 1987 [FR] France ..... 8710847

[51] Int. Cl.[4] ..... G01N 21/88

[52] U.S. Cl. ..... 356/238; 223/43

[58] Field of Search ..... 356/244, 238, 239, 242; 223/39, 42, 43

[56] References Cited

U.S. PATENT DOCUMENTS 3,520,454 7/1970 Saltiel ..... 223/43

*Primary Examiner*—Vincent P. McGraw

*Attorney, Agent, or Firm*—Herbert Dubno

[57] ABSTRACT

An apparatus for the insepction of tubular fabric articles like pantyhose has a form constituted of bars which can spread the article over an illuminated table. The table is provided with a row of bores which are trained upwardly against the garment to rapidly raise it onto and over the form. Upon termination of the insepction, the garment falls, at least in part by gravity, from the form.

9 Claims, 3 Drawing Sheets

APPARATUS FOR THE INSPECTION OF TUBULAR TEXTILE PRODUCTS

FIELD OF THE INVENTION

Our present invention relates to an apparatus for the inspection of tubular textile products such as stockings, pantyhose, tights and the like having one or more tubular portions which can be spread to permit visual detection of defects when the textile product is illuminated from behind.

BACKGROUND OF THE INVENTION

For tubular textile products such as those mentioned, it is advantageous to provide an inspection stage in conjunction with fabrication, generally prior to conditioning of the fabricated product.

This inspection is most commonly carried out visually after the article has been placed upon a form permitting the article to be spread out or drawn transversely in front of an illuminated plate or table such as a light box so that the article is transluminated and it is possible for an inspector to detect the presence of any flaws.

Various means have been utilized heretofore for placing the article on the form, for effecting a transverse spread of the article by transverse displacement of the form and for release of the article after it has been inspected.

In order to illustrate one approach used in the prior art, especially in an apparatus for the inspection of pantyhose or tights, the form is constituted by two pairs of parallel rods, each pair comprising a fixed rod and a transversely movable rod. The pantyhose are placed over this form and the two movable rods are then displaced to spread the article, permitting visual inspection in the manner described. After inspection, the movable rods are returned to their original positions and the article is ejected by a jet of compressed air directed into the article.

The ability to process a large number of articles at a high rate is poor because of the need to draw the pantyhose completely over the rods on mounting the article on the form.

German patent document No. 1,410,870 describes an inspection apparatus in which an air curtain under pressure is provided to draw the article downwardly over the form for inspection in a similar manner. While the output of such an apparatus is greatly improved because of the automatic threading of the article over the bars of the form by the air curtain directed obliquely downwardly and because a downward movement permits more rapid placing of the article on the form, this apparatus has the disadvantage that the downward movement of the article over the form cannot avoid the formation of pockets in the tubular portions or stockings which may be inspected. As a result, stockings may not be completely stretched or leg portions of pantyhose may not be completely stretched so that rigorous inspection cannot be ensured.

OBJECTS OF THE INVENTION

It is the principal object of the present invention to provide an inspection apparatus for the purposes described which avoids the drawbacks of the prior art systems.

Another object of this invention is to provide an improved inspection apparatus which allows a tubular fabric article or garment to be rapidly placed upon the form, stretched and inspected so that a rigorous inspection can be performed and yet the rate at which articles can be inspected is significantly higher than has been attainable heretofore.

SUMMARY OF THE INVENTION

These objects and others which will become apparent hereinafter are attained, in accordance with the invention in an apparatus which has a light table and an extensible form disposed forwardly of this table and having at least two arms including a moveable arm and a fixed arm, the movable arm being transversely displaceable relative to the fixed arm to spread a tubular portion of a textile article drawn over the form. Means is provided for directing an air curtain upwardly onto the pantyhose or other textile article which can be open upwardly and is propelled upwardly by the air curtain which automatically causes the article to slide completely over the form.

According to the invention, the illuminated table is traversed over its entire thickness by orifices or bores which are oriented obliquely upwardly and which communicate with a casing or compressed air duct located rearwardly of the table to direct jets of air forwardly of the table and upwardly in the direction in which the tubular portions or stockings are drawn onto the form.

More specifically, the apparatus for the inspection of tubular textile products can comprise:

an illuminated table;

a form for receiving a tubular textile product to be inspected and disposed along a front face of the illuminated table, the form comprising two pairs of mutually parallel arms extending generally upwardly and each receiving a tubular textile portion with each pair including a fixed arm and a transversely movable arm;

means for displacing the transversely movable arms upon the respective textile portions having been drawn over the respective pairs of arms, thereby spreading the portions and enabling inspection thereof with light from the table, the table being traversed over the entire thickness thereof by oblique orifices oriented to direct respective jets of air forwardly toward the front face and upwardly at the tubular textile product to be inspected and to draw the portions upwardly over the arms; and means along a rear surface of the table communicating with the orifices for delivering compressed air to the orifices.

The bores or orifices are preferably arrayed in two rows or lines which are parallel to one another and parallel to the arms of the form, the spacing of the bores from one another along each row being irregular in the sense that this spacing increases from the region of the free end of each arm to the region of its fixed extremity, i.e. upwardly.

Of course, the nozzles can additionally or alternatively be provided on a fixed element of the form, e.g. one of the fixed bars. In that case, the nozzles also communicate with a supply duct for the compressed air.

According to a feature of the invention, means can be provided for connecting the nozzles to a source of compressed air, this means being activated automatically when a textile article is presented manually to the apparatus.

The oblique compressed-air curtain formed by the jets issuing from the nozzles or orifices alone can serve to completely transfer the pantyhose or tights onto the form. When the garment is totally in place on the form, the form can open and spread transversely, to thereby spread the article in front of the illuminated table to enable the inspection. When inspection is complete, the form can retract and the pantyhose can simply fall from the form by gravity.

If the illuminated table is vertical or lies in an inclined plane approaching the vertical, the garment can descend by the simple effect of gravity. The supply of air which directed the upward jets placing the article on the form can then be cut off or, if desired, a slight suction can be applied to the casing or ducts so that a downward flow of air is induced to facilitate the gravitational action. It is, however, also possible to accelerate the disengagement of the article by a jet of compressed air directed obliquely downwardly against the article, i.e. in a direction opposite to the direction of the air curtain lifting the article.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
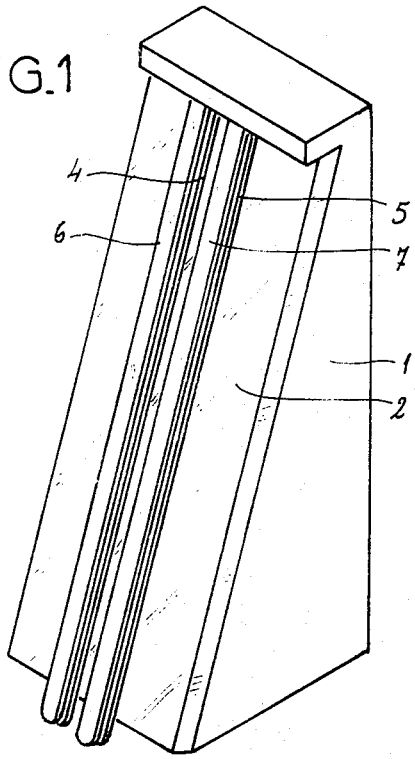
FIG. 1 is a diagrammatic perspective view showing the apparatus in its starting position before an article has been applied thereto.

As shown in FIGS. 1–4, the apparatus generally comprises an upright casing or stand 1 defining an inclined plane for an illuminating table 2 which approaches the vertical. As will be apparent from FIG. 7, the inclination of the illuminated plate 2 can be adjusted to the needs or desires of th garment inspector.

The illuminated table 2 is constituted by a translucent surface behind which can be provided appropriate lamps, especially fluorescent tubes which are not visible in these Figures. In front of this illuminating table, is located the form adapted to receive the pantyhose to be inspected one by one.

This form which has been generally represented at 3 is constituted by 4 transparent glass bars or rods disposed in two pairs, each pair comprising a fixed bar and a movable bar. The two fixed bars are represented at 4 and 5 and the two movable bars are seen at 6 and 7.

The movable bars are parallel to the fixed bars 4 and 5 and are located above or forwardly of the latter. The bars 6 and 7 can be displaced respectively to the left and to the right, i.e. laterally or transversely.

Supports not seen in the drawing engage the upper ends of the bars and the supports of the movable bars 6 and 7 impart to them the back and forth movements necessary force allowing the garment to be placed over the form and for spreading the garment respectively.

According to an important feature of the invention, the plate 2 forming the illuminated table is provided with bores or orifices 8. The orifices 8 are oblique and their inclinations are such that they direct respective jets of compressed air forwardly of the illuminated table and upwardly. The orifices are spaced apart vertically with a spacing which increases in the upward direction.

Along the rear surface of the table 2, the orifices communicate with a casing, ductwork or the like which, in turn, is connected with a compressed-air source and the supply of compressed air is automatically programmed.

Figure 5:
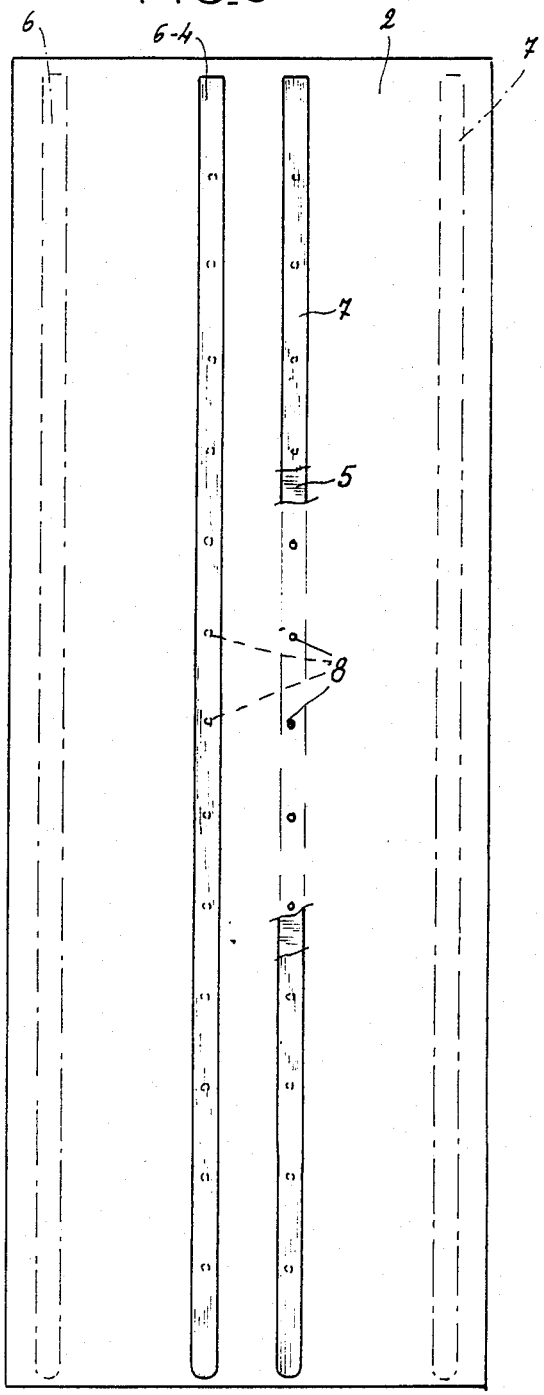
FIG. 5 is an elevational view of a portion of the light table also in somewhat diagrammatic form.

The orifices 8 are disposed in two parallel lines or rows visible in FIG. 5 directly behind the two fixed bars 4 and 5 of the form.

When the apparatus is at rest, the two movable bars 6 and 7 lie immediately forwardly and in registry with the respective fixed bars 4 and 5. This is the position shown in FIG. 1.

Figure 2:
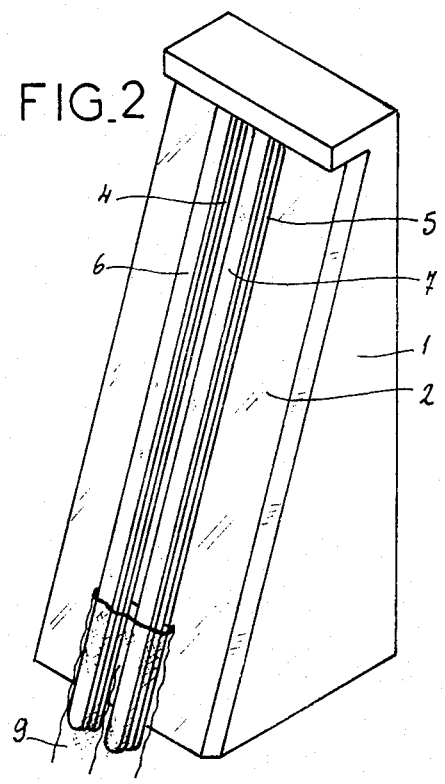
FIGS. 2–4 are perspective views illustrating various phases of the functioning of the apparatus.
Figure 6:
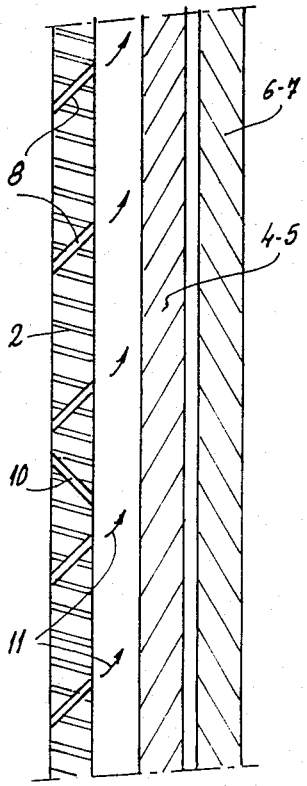
FIG. 6 is a fragmentary vertical section through a portion of the apparatus drawn to a larger scale.

In this position, a pair of pantyhose generally represented at 9 can be manually brought to a position at the lower end of the form 3 at which the waistband portion **9*a* has been slightly raised onto the form. FIG. 2 shows this phase of the operation. Compressed air is supplied to the orifices 8 automatically and as a result there is an oblique sheet of compressed air represented at 11 in FIG. 6 which is directed upwardly to draw the garment upwardly over the entire height of the form until the closed ends of the garment, i.e. the ends forming the leg portions, reach the lower extremities of the form. This is the position shown in FIG. 3 in which each of the legs of the pair of pantyhose covers respectively one of the pairs 4, 6 of bars while the other leg covers the other bar of bars 5, 7**.

Figure 3:
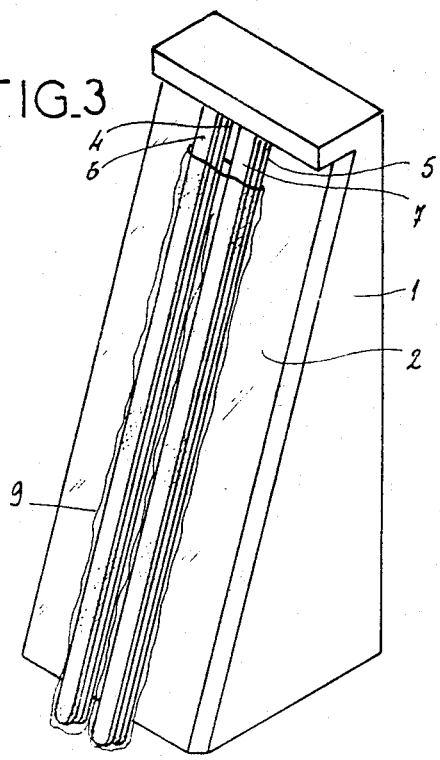
Figure 4:
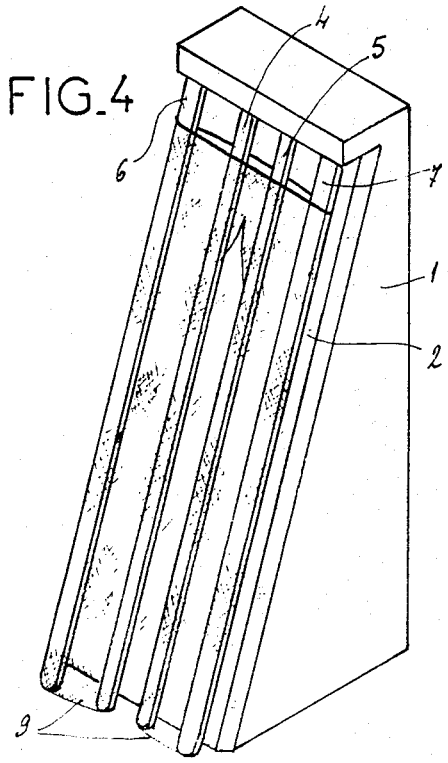

When the garment is in the position shown in FIG. 3, two bars 6 and 7 are displaced laterally into position shown in dot-dash lines in FIG. 5 and as has been illustrated in FIG. 4, thereby stretching the garment across the light table 2. When inspection is terminated, the two bars 6 and 7 return to their original positions shown in FIG. 3 and the garment can descend under the effect of its weight or can be accelerated downwardly by a jet of air directed downwardly through the orifice 10, i.e. in a direction opposite the direction of orifices 8.

Clearly the invention is not limited to the embodiments of the apparatus described and will include all variants within the spirit and scope of the appended claims. Any means can be provided to generate the oblique air curtain automatically and, naturally, the inspection need not be visual but can be automatic.

The invention can be applied in cases in which a single pair of bars may be provided if, for example, a stocking is to be inspected rather than a pair of pantyhose. Other applications for which the apparatus may be suitable, also can be carried out since the apparatus is not limited with respect to how it may be used.

Figures 7, 8:
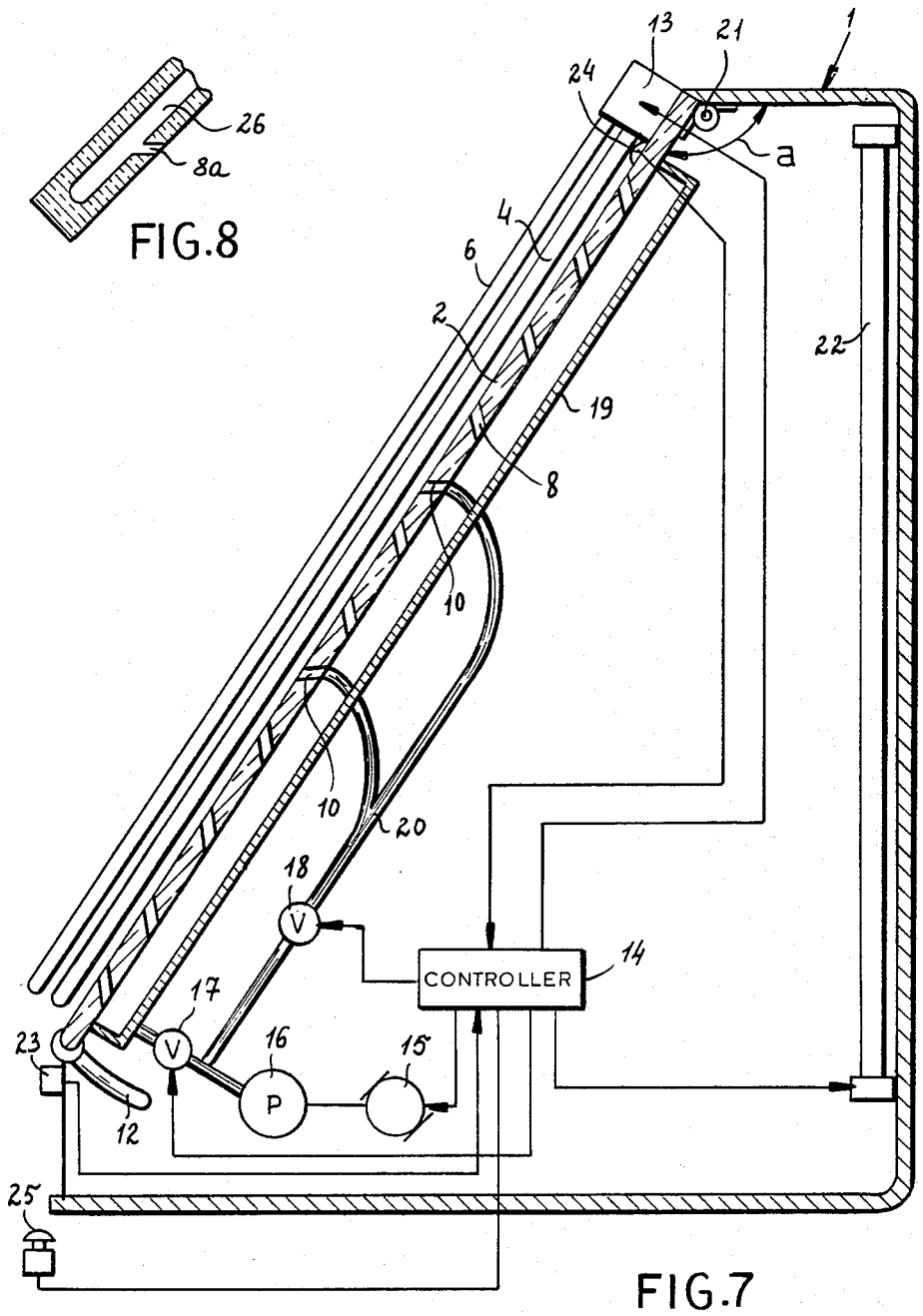
FIG. 7 is a vertical cross-sectional view taken perpendicular to the plane of the light table of the apparatus showing features thereof not visible in other Figures.
FIG. 8 is a detail view of a modified arrangement of a nozzle orifice.

FIG. 7 shows that the table 2 can be hinged at 21 at the upper end of the casing 1 which includes fluorescent lamps 22 for illuminating the translucent table. The guide 12 for the lower end can be provided to enable the table to be locked in place at any appropriate angle a by suitable locking means (not shown).

The mechanism 13 for displacing the bars 6 and 7 laterally has also been illustrated in this Figure and is connected to a controller 14 which, in turn, controls a motor 15, driving a compressor 16 for generating the compressed air.

Valves 17 and 18, respectively, control the flow of air of a plenum 19 feeding the orifices 8 and to pipes 20 supplying the orifices 10. The lamp 22 is also operated by the controller 14.

As the garment is brought close to the lower end of the apparatus, a sensor 23 triggers the controller 14 to turn on the lamps 22, and the compressor motor 15 and to open valve 17 for the upward displacement of the garment solely by the upward air curtain 11 as previously described. When a sensor 24 at the upper end of the device is reached by the garment, the controller 14 is triggered to operate the drive 13 and spread the bars in the manner described. When inspection is completed, the operator can tap the switch 25, whereupon the controller 14 will close valve 17 and reverse the drive 13 to return the bars to the position shown in FIG. 3, whereupon valve 18 is opened to eject the garment.

As has been shown in FIG. 8, the fixed bars 4 and 5 can be provided with orifices 8*a* connected by ducts 26 to provide an additional impetus upwardly for placing the garment on the form. The duct 26 will then be connected by an appropriate valve to the controller 14.

We claim:

1. An apparatus for the inspection of tubular textile products, comprising:

an illuminated table;

a form for receiving a tubular textile product to be inspected and disposed along a front face of said illuminated table, said form comprising two pairs of mutually parallel arms extending generally upwardly and each receiving a tubular textile portion with each pair including a fixed arm and a transversely movable arm;

means for displacing said transversely movable arms upon the respective textile portions having been drawn over the respective pairs of arms, thereby spreading said portions and enabling inspection thereof with light from said table, said table being traversed over the entire thickness thereof by oblique orifices oriented to direct respective jets of air forwardly toward said front face and upwardly at said tubular textile product to be inspected and to draw said portions upwardly over said arms; and means along a rear surface of said table communicating with said orifices for delivering compressed air to said orifices.

2. The apparatus defined in claim 1 wherein said means along a rear surface of said table communicating with said orifices includes a casing communicating with a multiplicity of said orifices and forming a plenum communicating with a source of compressed air.

3. The apparatus defined in claim 1 wherein said means along a rear surface of said table communicating with said orifices includes at least one duct communicating with a multiplicity of said orifices and forming a plenum communicating with a source of compressed air.

4. The apparatus defined in claim 1 wherein said orifices are disposed in two rows, each of said rows lying directly behind a respective one of said fixed arms.

5. The apparatus defined in claim 1 wherein said orifices are disposed in rows and are spaced apart along said rows with a spacing which increases upwardly.

6. The apparatus defined in claim 1 wherein said arms are transparent flat glass rods.

7. The apparatus defined in claim 1 wherein said fixed arms are formed with upwardly directed orifices supplied with compressed air.

8. An apparatus for the inspection of tubular textile products, comprising:

an illuminated table;

a form for receiving a tubular textile product to be inspected and disposed along a front face of said illuminated table, said form comprising two pairs of mutually parallel arms extending generally upwardly and each receiving a tubular textile portion with each pair including a fixed arm and a transversely movable arm;

means for displacing said transversely movable arms upon the respective textile portions having been drawn over the respective pairs of arms, thereby spreading said portions and enabling inspection thereof with light from said table, said fixed arms of said form being provided with oblique orifices oriented to direct respective jets of air toward said front face and upwardly at said tubular textile product to be inspected and to draw said portions upwardly over said arms; and means communicating with said orifices for delivering compressed air to said orifices.

9. An apparatus for the inspection of tubular textile products, comprising:

an illuminated table;

a form for receiving a tubular textile product to be inspected and disposed along a front face of said illuminated table, said form comprising a pair of mutually parallel arms extending generally upwardly and receiving a tubular textile portion, said pair of arms including a fixed arm and a transversely movable arm;

means for displacing said transversely movable arm upon a textile portion having been drawn over the pair of arms, thereby spreading said portion and enabling inspection thereof with light from said table, said table being traversed over the entire thickness thereof by oblique orifices oriented to direct respective jets of air forwardly toward said front face and upwardly at said tubular textile product to be inspected and to draw said portions upwardly over said arms, said orifices being disposed in a row behind said fixed arm; and means along a rear surface of said table communicating with said orifices for delivering compressed air to said orifices.

* * * * *